United States Patent [19]

Fontenelle

[11] 4,121,134

[45] Oct. 17, 1978

[54] ROTATABLE MULTIPLE FILAMENT LAMP AND SOCKET ADAPTER

[76] Inventor: James Francis Fontenelle, 928 Clouet St., New Orleans, La. 70117

[21] Appl. No.: 845,999

[22] Filed: Oct. 27, 1977

[51] Int. Cl.[2] ..... H01K 1/62

[52] U.S. Cl. ..... 315/64; 313/51; 313/316

[58] Field of Search ..... 315/64, 66, 67, 68; 313/51

[56] References Cited

U.S. PATENT DOCUMENTS

| | | | |
|---|---|---|---|
| 476,183 | 5/1892 | Ball | 315/64 |
| 599,910 | 3/1898 | Lister | 315/64 X |
| 1,445,120 | 2/1923 | Wise | 315/64 |
| 1,449,627 | 3/1923 | Rohner et al. | 315/64 |
| 1,863,500 | 6/1932 | Piersimoni | 315/64 |
| 3,673,534 | 6/1972 | Marinace | 315/64 X |
| 3,886,400 | 5/1975 | Dill | 315/64 |

*Primary Examiner*—Alfred E. Smith
*Assistant Examiner*—Charles F. Roberts
*Attorney, Agent, or Firm*—James B. Lake, Jr.

[57] ABSTRACT

A multiple filament lamp has one set of ends of all filaments connected to a common conductor and the end of another set individually connected to separate conductors. The conductors are mounted in a non-conducting lamp base with the common conductor projecting centrally beyond the bottom of the base, and the separate conductors recessed into the side of the base and equally spaced around its circumference. The base is slidable into a socket-adapter having an outer conducting shell defining standard electric socket screw threads fixed to an inner non-conducting cylinder that is recessed interiorly at the top to receive a retainer ring for engaging a similar recess around the top of the lamp base, and recessed exteriorly to receive a conductor contact spring for biasing a spring end extending through the non-conducting cylinder inwardly into separate engagement with the respective conductors recessed in the lamp base as the lamp and its base are turned in the socket-adapter. The socket-adapter is screwable into a live electric socket by its conducting shell which is in contact with the contact spring and spring end. The lamp and base are rotatable in the socket-adapter to sequentially bring the separate recessed conductors into contact with the spring end to complete an electrical circuit with the live electric socket for each filament in turn through the common bottom conductor and respective separate side conductors.

2 Claims, 5 Drawing Figures

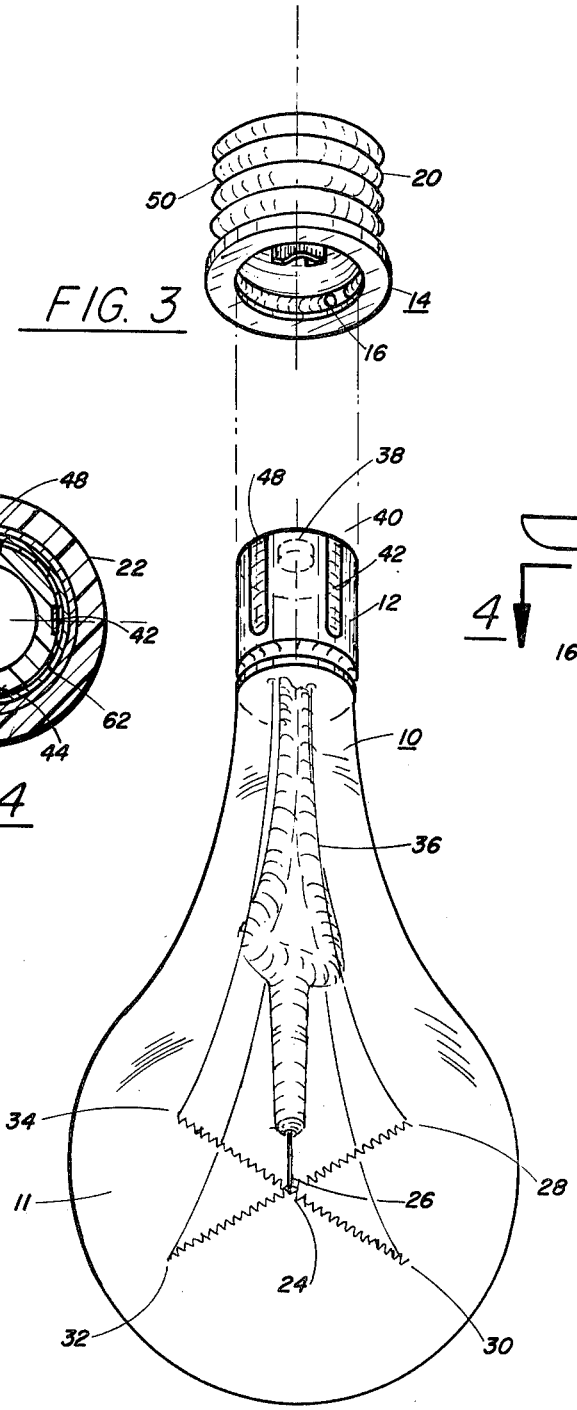
FIG. 3
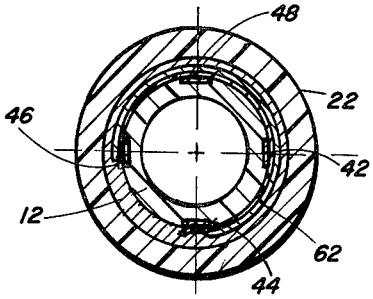
FIG. 4
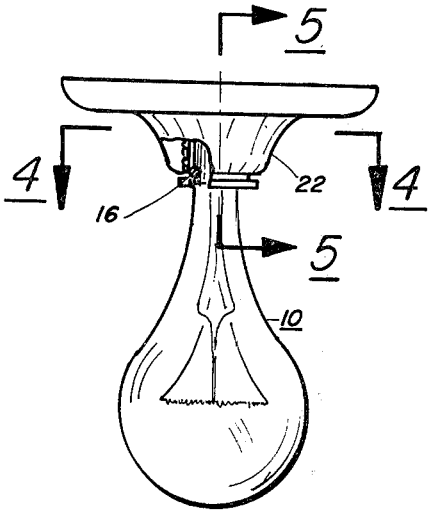
FIG. 1
FIG. 2
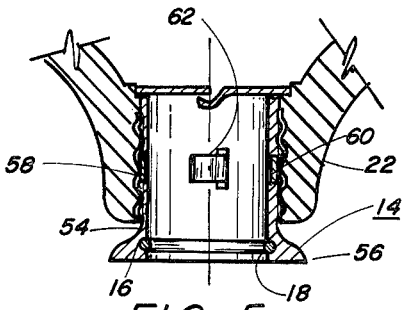
FIG. 5

ROTATABLE MULTIPLE FILAMENT LAMP AND SOCKET ADAPTER

BACKGROUND OF THE INVENTION

The invention generally relates to electric incandescent lamps, and more particularly to multiple filament lamps sequentially lightable one at a time by turning.

Multiple filament lamps are well known in the prior art, and fall into two classes: those that do not require the removal of the lamp from the socket to change filament connections, and those that do. In the first category, U.S. Pat. No. 599,910 to J. T. Lister more closely resembles the invention in purpose and result, differing in structure and functioning. It teaches two conductor springs of different lengths, the longer for contacting two terminals and the shorter for contacting only one terminal of the four terminals provided for two filaments. By turning the lamp in its base 180° the longer conductor spring is shifted from one set of filament terminals to the other to light the filament having both its terminasl contacted, the other filament circuit being uncompleted is not energised. The invention teaches a single conductor spring that in cooperation with a common ground energizes four filaments in succession by turning 270° in 90° increments. Also cited is G. Piersimoni, U.S. Pat. No. 1,863,500 that teaches a rotatable ring on a base and a common ground to successively light one of two filaments that are removable from the lamp.

In the second category, U.S. Patents to Dill, 3,886,400; Marinace, 3,673,534; Rohner, et al, 1,449,627; Wide, 1,445,120; and Ball, 476,183, generally provide selectors that have to be rotated or removed to successively energize filaments of a multiple filament lamp and/or couple them for increased light. In all cases this defeats the main purpose of the invention which is to reduce the number of times a maintenance man has to remove lamps from sockets in a building where a large number are kept burning over long periods of time.

SUMMARY OF THE INVENTION

It is an object of the invention to provide a multiple filament lamp that is sequentially lightable, by turning the lamp in a socket adapter that is screwable into an energized standard light socket, (filament by filament).

Another object of the invention is to reduce by ¾ths the number of times a lamp has to be removed from a socket per unit of time.

A further object of the invention is to provide a lamp that is replaceable by a simple axial pull to remove and push to install.

BRIEF DESCRIPTION OF THE DRAWINGS

FIG. 1 is a side elevation of the invention installed in a standard light socket;

FIG. 2 is the lamp portion of the invention in three dimensions;

FIG. 3 is a three dimensional view of the socket adapter portion of the invention;

FIG. 4 is a sectional view taken along section lines 4—4 of FIG. 3; and

FIG. 5 is a sectional view taken along section lines 5—5 of FIG. 1.

DETAILED DESCRIPTION

Referring to FIG. 1, the invention comprises a lamp 10 having a glass bulb 11 and a non-conducting base 12 adapted to be pushable slidable into freely rotatable engagement in a socket-adaptor 14, and be retained therein by a retainer snap ring 16 mounted between base 12 and adapter 14 in cooperating circumferential recesses 18, the adapter 14 having external threads 20 complementary to the internal threads of a standard electric socket 22 for engaging therewith.

Referring to FIGS. 2 and 4, bulb 11 has four separate filaments 24 meeting in a common junction 26 and having respectively oppositely disposed ends 28, 30, 32 and 34 mounted on a central non-conducting support 36 fixed to base 12 and extending into bulb 11. An axially projecting terminal 38 is mounted on the bottom 40 of base 12 and side terminals 42, 44, 46 and 48 are recessed into the side and equally spaced there around. The common junction 26 of terminals 24 is electrically connected to terminal 38 and the oppositely disposed filament ends 28, 30, 32 and 34 are respectively connected to side terminals 42, 44, 46 and 48.

Referring to FIGS. 3 and 5, socket adapter 14 comprises an outer conducting shell 50 defining external screw threads 20 complementary to internal screw threads defined in the standard electric socket 22 for rotatably securing socket adapter therein. An internal liner 54 of non-conducting material is fixed in conducting shell 50 and extends therebeyond in a flanged base receiving end 56 that defines interiorly one of cooperating recesses 18 that engages retainer snap ring 16. An external circumferential recess 58 is defined betweeen the ends of liner 54, and a spring contact band 60 is engaged therein contacting conducting shell 50. An end portion 62 of spring contact band 60 extends through an opening defined in the recess of non-conducting liner 54 for contacting one of side terminals 42, 44, 46 or 48 as lamp 10 is turned in the socket adapter.

In use socket adapter 14 is tightly screwed into an energized standard light socket 22 and seldom needs replacing. The base 12 of a lamp 10 is inserted into the socket until retainer snap ring 16 mounted as aforesaid in liner's flanged end 56 of the socket adapter is engaged by the circumferential recess 18 defined in base 12 to hold the lamp in the socket adapter and free to turn without rotating the socket adapter and with its projecting base terminal 28 in electrical contact with base terminal 64 of socket 22. The lamp is then rotated in the socket adapter to register one of the side terminals 28–34 with end portion 62 of the spring contact thereby completing a circuit through one of the filaments to the common base terminal. When a filament burns out a quarter turn registers another side base terminal with the spring contact to complete the circuit and so on until all four filaments are burned out. The lamp can then be removed by pulling the lamp from the socket adapter past the retaining ring and pushing another into its place, thus eliminating the danger of twisting a bulb out of its base and the need to start the frozen threads of screw-in lamps and sockets.

What is claimed is:

1. A multiple filament lamp, lightable one filament at a time and comprising in combination:

(a) Non-conducting base means having a bottom terminal and a plurality of recessed side terminals for defining a plurality of open circuits therebetween, and having a circumferential retainer recess exteriorly defined adjacent an end of said base means with a retainer snap ring mounted in said recess;

(b) Glass bulb means, having the same plurality of filaments therein as said plurality of recessed side terminals in said base means, fixed on the end of said base means adjacent said circumferential recess, said plurality of filaments having a side of all said filaments connected to said bottom terminal means, and other side of each filament of said plurality of filaments connected to said respective side terminals recessed in said base means; and (c) Socket adapter means, adapted to screw into a standard lamp socket having energized bottom and side terminals, and defining and opening for slidably receiving and replaceably retaining said base and bulb means for free rotation therein and with said bottom terminal of said base means registering with said energized bottom terminal of said standard lamp socket, and with conducting means mounted in said socket adapter means for sequentially registering said plurality of side terminals of said base means with said energized side terminal of said standard lamp socket as said base and bulb means are rotated, thereby sequentially energizing said filaments one at a time.

2. A multiple filament lamp as described in claim 1 wherein said socket adapter means comprises:

(a) a conducting outer shell defines exterior screw threads complementary to interior screw threads defined in said standard lamp socket for connecting said socket adapter means therein;

(b) A non-conducting internal liner fixed in said outer shell and defining an interior retainer recess complementary to said exterior retainer recess defined in said base means for co-engaging said snap retainer ring and defining an external circumferential recess and hole spaced axially inwardly of said interior retainer recess; and (c) A spring contact mounted in said external circumferential recess in contact with said conducting out shell, and with an end of said spring contact extending through said hole in said external circumferential recess and adapted to contact one only of said plurality of recessed side terminals in said base means as said base means if freely rotated in said socket adapter means.

* * * * *